US009769914B2

(12) United States Patent
Roy

(10) Patent No.: US 9,769,914 B2
(45) Date of Patent: Sep. 19, 2017

(54) DEVICES EMPLOYING ONE OR MORE PLASMA ACTUATORS

(71) Applicant: University of Florida Research Foundation, Inc., Gainesville, FL (US)

(72) Inventor: Subrata Roy, Gainesville, FL (US)

(73) Assignee: UNIVERSITY OF FLORIDA RESEARCH FOUNDATION, INC, Gainesville, FL (US)

( * ) Notice: Subject to any disclaimer, the term of this patent is extended or adjusted under 35 U.S.C. 154(b) by 147 days.

(21) Appl. No.: 14/656,199

(22) Filed: Mar. 12, 2015

(65) Prior Publication Data

US 2015/0264794 A1 Sep. 17, 2015

Related U.S. Application Data

(60) Provisional application No. 61/953,048, filed on Mar. 14, 2014.

(51) Int. Cl.
*H05H 1/24* (2006.01)

(52) U.S. Cl.
CPC ... *H05H 1/2406* (2013.01); *H05H 2001/2412* (2013.01); *H05H 2001/2468* (2013.01)

(58) Field of Classification Search
CPC ..... H05H 1/2406; H05H 2001/2468; H05H 2001/2412
See application file for complete search history.

(56) References Cited

U.S. PATENT DOCUMENTS 8,235,072 B2 8/2012 Roy
8,342,234 B2 1/2013 Ouyang
2008/0179286 A1* 7/2008 Murokh ..... A61L 2/14 216/67
2009/0169356 A1 7/2009 Wadia et al.
2010/0329838 A1 12/2010 Greenblatt
2011/0287193 A1* 11/2011 Creyghton ..... C23C 16/50 427/569
2011/0308457 A1* 12/2011 Simor ..... H05H 1/2406 118/719
2013/0038199 A1 2/2013 Roy et al.
2013/0064726 A1* 3/2013 Morfill ..... A01J 7/04 422/186.21

FOREIGN PATENT DOCUMENTS

WO 2011/156408 A2 12/2011

OTHER PUBLICATIONS

Performance Improvement of Axial Compressors and Fans with Plasma Actuation (Source: International Journal of Rotating Machinery vol. 2009 (2009), Article ID 247613, 13 pages—Author(s): Sebastien Lemire,1 Huu Duc Vo,1 and Michael W. Benner2—http://www.hindawi.com/journals/ijrm/2009/247613/.

* cited by examiner

*Primary Examiner* — Donald Raleigh
*Assistant Examiner* — Kevin Quarterman
(74) *Attorney, Agent, or Firm* — Thomas Horstemeyer, LLP; Christopher B. Linder; Jason M. Perilla

(57) ABSTRACT

Various embodiments relate to plasma actuators that generate fluidic flow. In one or more embodiments, a plasma actuator includes a first electrode and a second electrode. A dielectric film physically separates the first electrode and the second electrode of the plasma actuator. The dielectric film is configured to be attached to a surface to facilitate the plasma actuator providing fluidic flow for an environment.

20 Claims, 8 Drawing Sheets

DEVICES EMPLOYING ONE OR MORE PLASMA ACTUATORS

CROSS-REFERENCE TO RELATED APPLICATIONS

The present application is a non-provisional application of, and claims priority to, U.S. Provisional Application No. 61/953,048, filed on Mar. 14, 2014 and titled "DEVICES EMPLOYING ONE OR MORE PLASMA ACTUATORS," which is incorporated by reference herein in its entirety.

BACKGROUND

The rotating components of some machines, such as fans, wheel and axle assemblies, and propeller systems, are commonly driven by electric motors. Electric motors cause components to rotate in response to magnetic fields that are generated within the electric motors. However, moving parts for these electric motors can wear out and require replacement.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure describes various types of devices that employ one or more plasma actuators. Non-limiting examples of plasma actuators are described in U.S. Pat. No. 8,235,072, titled "Method and Apparatus for Multibarrier Plasma High Performance Flow Control," issued on Aug. 7, 2012, U.S. Publication No. 2013/0038199, titled "System, Method, and Apparatus for Microscale Plasma Actuation," filed on Apr. 21, 2011, and WIPO Publication No. WO/2011/156408, titled "Plasma Inducted Fluid Mixing," filed on Jul. 6, 2011. Each of these documents is incorporated by reference herein in its entirety. In general, a plasma actuator may induce the flow of a fluid, such as air or any other type of fluid in which the plasma actuator is located, due to the electrohydrodynamic (EHD) body force that results from the electric field lines that are generated between electrodes of the plasma actuator. As will be described in further detail below, some embodiments of the present disclosure use one or more plasma actuators to drive one or more components of a rotating machine. Other embodiments of the present disclosure relate to a spiral plasma actuator. Furthermore, some embodiments of the present disclosure are directed towards an apparatus that may be mounted to a suitable structure to provide fluid flow using one or more plasma actuators.

Plasma-Driven Rotating Machines

Figure 1B:
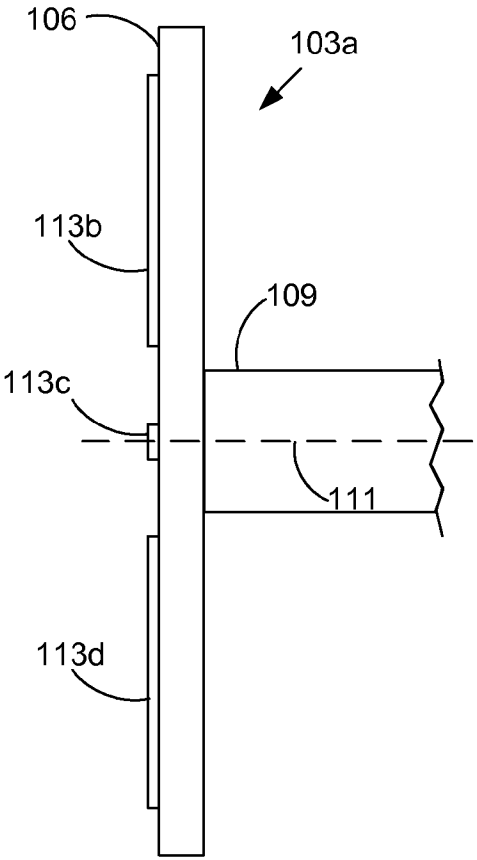
FIGS. 1A-1B are drawings of a first example of a plasma-driven rotating machine according to various embodiments of the present disclosure.
Figure 1A:
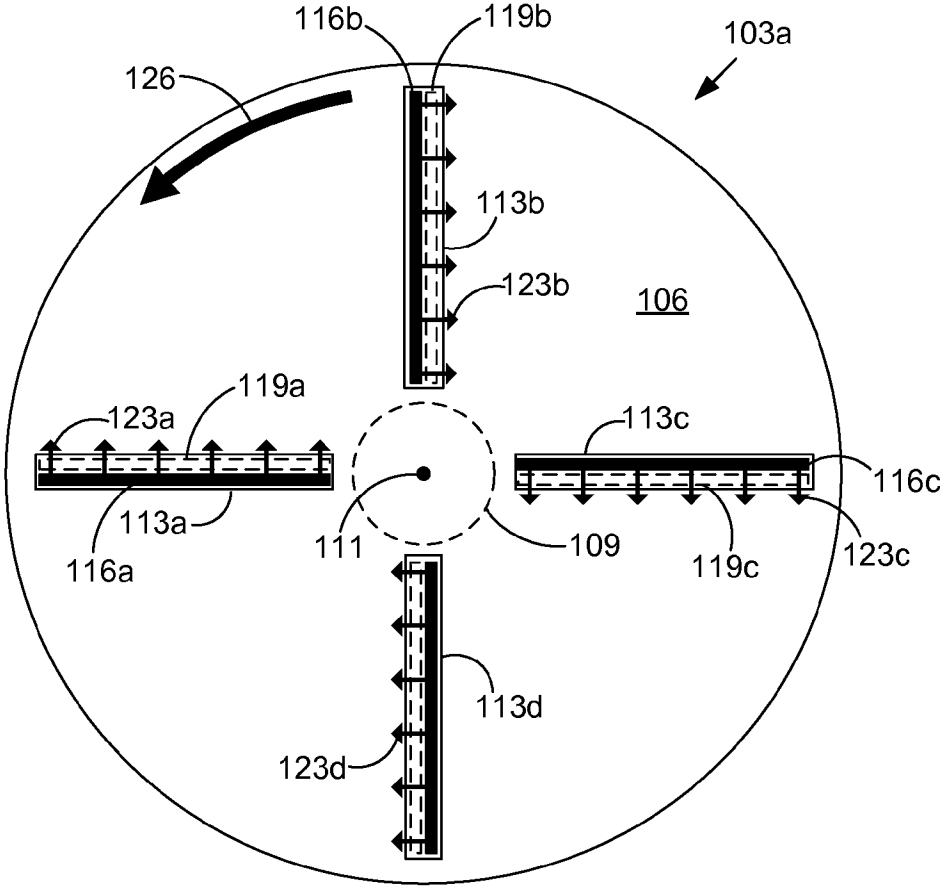

With reference to FIGS. 1A-1B, shown is an example of a plasma-driven rotating machine 103*a* according to various embodiments of the present disclosure. In particular, FIG. 1A shows a front view of the rotating machine 103*a*, and FIG. 1B shows a side view of the rotating machine 103*a*. The rotating machine 103*a* shown in FIGS. 1A-1B includes a wheel 106, a shaft 109, and potentially other components. The shaft 109 may function as a support member for the wheel 106. The wheel 106 is configured to rotate about an axis 111 defined by the shaft 109. To this end, a bearing or other suitable mechanism may be used to facilitate rotation of the wheel 106 about the axis 111.

One or more plasma actuators 113*a*-113*d* are attached to the wheel 106. Each of the plasma actuators 113*a*-113*d* includes one or more first electrodes 116*a*-116*d* and one or more corresponding second electrodes 119*a*-119*d*, respectively. The first electrodes 116*a*-116*d* and second electrodes 119*a*-119*d* may have linear, serpentine (e.g., sinusoidal), or any other suitable type of geometry. For embodiments using first electrodes 116*a*-116*d* and second electrodes 119*a*-119*d* that have linear geometry, the plasma actuators 113*a*-113*d* may be positioned such that the first electrodes 116*a*-116*d* and second electrodes 119*a*-119*d* extend radially from the center of the wheel 106. In this position, when a voltage is applied across the respective first electrodes 116*a*-116*d* and second electrodes 119*a*-119*d*, respective EHD body forces are produced in the directions shown by the arrows 123*a*-123*d*. For purposes of clarity, only some of the arrows 123*a*-123*d* are labeled in FIG. 1A. Because the wheel 106 is configured to rotate about the axis 111, the EHD body forces may cause the wheel 106 to rotate about the axis 111 in the direction indicated by the arrow 126. Thus, in one embodiment, the location of the shaft 109 may be fixed, and the EHD body forces may cause the wheel 106 to rotate about the fixed axis 111. In another embodiment, the shaft 109 may be free to travel, and the EHD body forces may cause the wheel 106 to rotate and thereby travel along a surface by rotating about the axis 111.

The plasma actuators 113*a*-113*d* may be activated using a signal generator. In various embodiments, the signal generator is capable of applying voltages with various types of waveforms across the respective first electrodes 116*a*-116*d* and second electrodes 119*a*-119*d*. For example, the plasma actuators 113*a*-113*d* may be activated by applying a constant voltage across the respective first electrodes 116*a*-116*d* and second electrodes 119*a*-119*d*. As another example, a sinusoidal voltage may be applied to the plasma actuators 113*a*-113*d*. Additionally, each one of the plasma actuators 113*a*-113*d* may be individually activated and deactivated according to a predefined pattern.

Figure 2B:
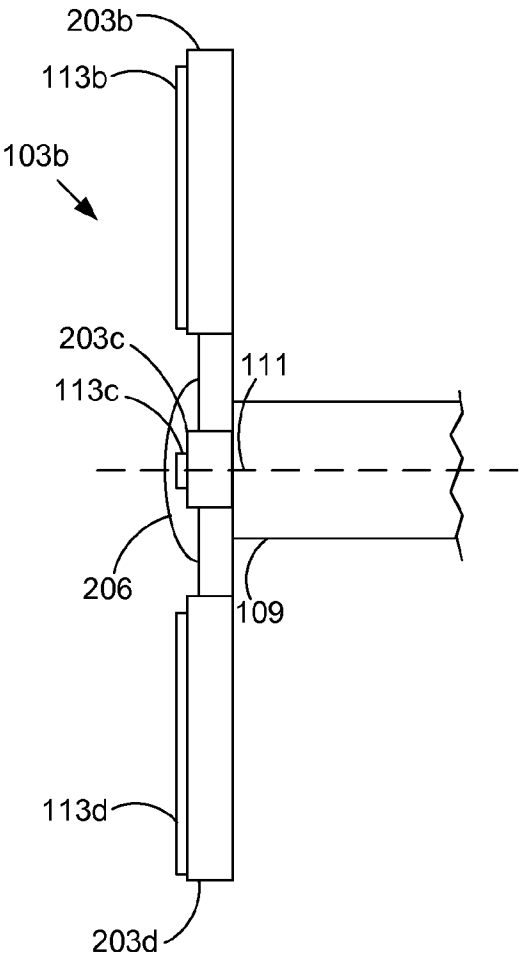
FIGS. 2A-2B are drawings of a second example of a plasma-driven rotating machine according to various embodiments of the present disclosure.
Figure 2A:
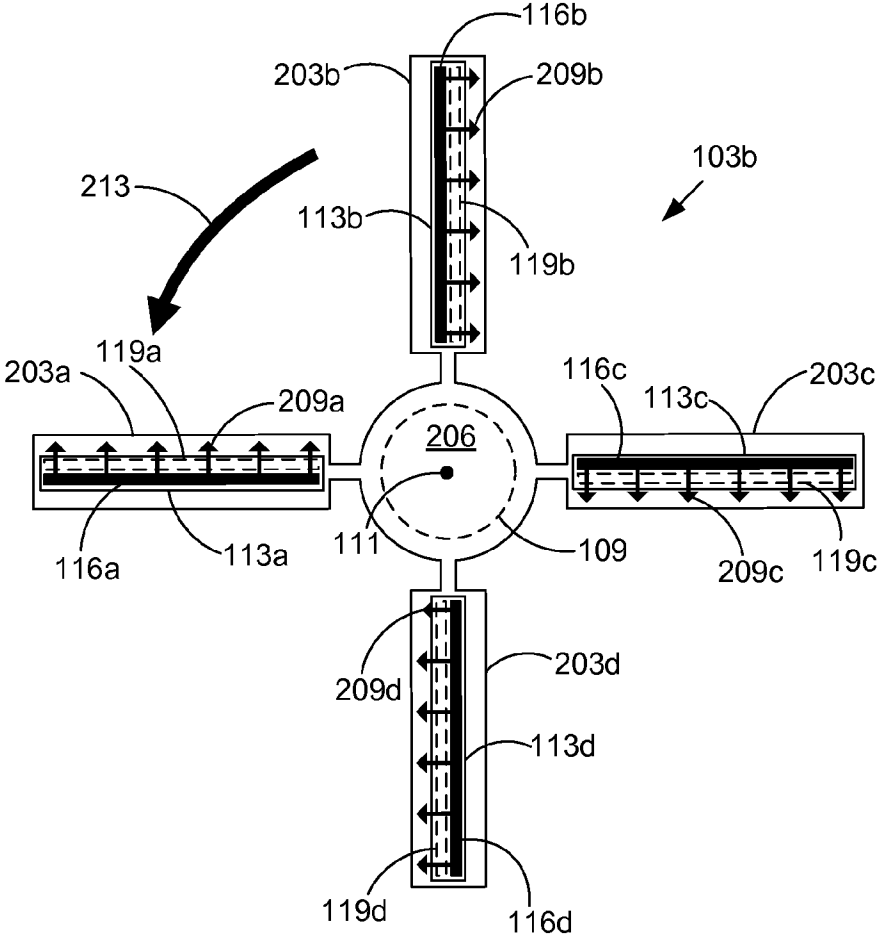

With reference to FIGS. 2A-2B, shown is another example of a plasma-driven rotating machine 103*a*, referred to herein as the rotating machine 103*b*, according to various embodiments of the present disclosure. In particular, FIG. 2A shows a front view of the rotating machine 103*b*, and FIG. 2B shows a side view of the rotating machine 103*b*.

As shown, the rotating machine 103*b* may include one or more arms 203*a*-203*d* that are attached to a hub 206. In some embodiments, the arms 203*a*-203*b* may comprise one or more blades, such as fan blades or propeller blades, that form airfoils. The hub 206 and arms 203*a*-203*d* are configured to rotate about an axis 111 defined by the shaft 109. To this end, bearings or any other suitable mechanism may facilitate the hub 206 being rotatable with respect to the shaft 109. The shaft 109 may function as a support member for the hub 206 and the arms 203*a*-203*d*.

One or more plasma actuators 113*a*-113*d* may be attached to one or more of the arms 203*a*-203*d*. Each of the plasma actuators 113*a*-113*d* includes one or more first electrodes 116*a*-116*d* and one or more corresponding second electrodes 119*a*-119*d*. The first electrodes 116*a*-116*d* and second electrodes 119*a*-119*d* may have linear, serpentine, or any other suitable type of geometry. For embodiments using first electrodes 116*a*-116*d* and second electrodes 119*a*-119*d* that have linear geometry, the plasma actuators 113*a*-113*d* may be positioned such that the first electrodes 116*a*-116*d* and second electrodes 119*a*-119*d* extend radially from hub 206. In this position, when the plasma actuators 113*a*-113*d* are activated, respective EHD body forces may be produced in the directions shown by the arrows 209*a*-209*d*. For purposes of clarity, only some of the arrows 209*a*-209*d* are labeled in FIG. 2A. Because the hub 206 is configured to rotate about the axis 111, the EHD body forces may cause the arms 203*a*-203*d* and the hub 206 to rotate about the axis 111 in the direction indicated by the arrow 213. Thus, the embodiment illustrated in FIGS. 2A-2B may operate as a fan, propeller, or other rotating machine that accelerates the fluid (e.g., air or water) in which the rotating machine 103*b* is located. Accordingly, the rotating machine 103*b* can be used to propel an object. Alternatively, the rotating machine 103*b* can be used to accelerate a fluid, such as air, across an object to thereby cool the object by facilitating heat transfer.

The plasma actuators 113*a*-113*d* may be activated using a signal generator. In various embodiments, the signal generator is capable of applying voltages with various types of waveforms across the respective first electrodes 116*a*-116*d* and second electrodes 119*a*-119*d*. For example, the plasma actuators 113*a*-113*d* may be activated by applying a constant voltage across the respective first electrodes 116*a*-116*d* and second electrodes 119*a*-119*d*. As another example, a sinusoidal voltage may be applied to the plasma actuators 113*a*-113*d*. Additionally, each one of the plasma actuators 113*a*-113*d* may be individually activated and deactivated according to a predefined pattern.

Figure 3B:
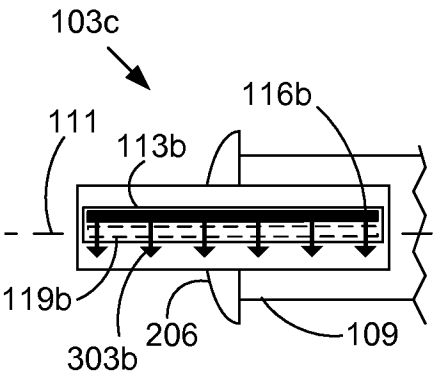
FIGS. 3A-3B are drawings of third example of a plasma-driven rotating machine according to various embodiments of the present disclosure.
Figure 3A:
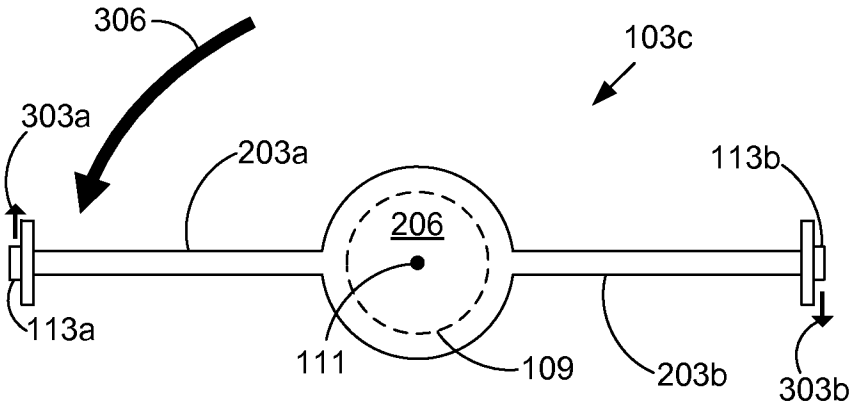

With reference to FIGS. 3A-3B, shown is another example of a plasma-driven rotating machine 103*a*, referred to herein as the rotating machine 103*c*. FIG. 3A shows a front view of the rotating machine 103*c*, and FIG. 3B shows a side view of the rotating machine 103*c*.

As shown, the rotating machine 103*c* may include one or more arms 203*a*-203*b* that are attached to a hub 206. In some embodiments, the arms 203*a*-203*b* may be embodied in the form of blades that may form airfoils. The hub 206 and arms 203*a*-203*b* are configured to rotate about an axis 111 defined by the shaft 109. To this end, bearings or any other suitable mechanism may be used to facilitate the hub 206 being rotatable with respect to the shaft 109. The shaft 109 may function as a support member for the hub 206 and the arms 203*a*-203*b*.

One or more plasma actuators 113*a*-113*b* may be attached to one or more of the arms 203*a*-203*b*. Each of the plasma actuators 113*a*-113*d* includes a first electrode 116*a*-116*d* and a corresponding second electrode 119*a*-119*d*. The first electrodes 116*a*-116*d* and second electrodes 119*a*-119*d* may have linear, serpentine, or any other suitable type of geometry. For embodiments using first electrodes 116*a*-116*d* and second electrodes 119*a*-119*d* that have linear geometry, the plasma actuators 113*a*-113*b* may be positioned so that the first electrodes 116*a*-116*b* and second electrodes 119*a*-119*d* are parallel to the axis 111 and perpendicular to the arms 203*a*-203*b*. In this position, when the plasma actuators 113*a*-113*d* are activated, respective EHD body forces may be produced in the directions shown by the arrows 303*a*-303*b*. For purposes of clarity, only some of the arrows 303*a*-303*b* are labeled in FIG. 3B. Because the hub 206 is configured to rotate about the axis 111, the EHD body forces may cause the arms 203*a*-203*b* and the hub 206 to rotate about the axis 111 in the direction indicated by the arrow 306. Thus, the rotating machine 103*c* illustrated in FIGS. 3A-3B may operate as a fan, propeller, or other rotating system that accelerates the fluid (e.g., air or water) in which the rotating machine 103*c* is located. Accordingly, the rotating machine 103*c* can be used to propel an object that is attached to the rotating machine 103*c*. Alternatively, the rotating machine 103*c* can be used to accelerate a fluid, such as air, across an object to thereby cool the object by facilitating heat transfer.

The plasma actuators 113*a*-113*d* may be activated using a signal generator. In various embodiments, the signal generator is capable of applying voltages with various types of waveforms across the respective first electrodes 116*a*-116*d* and second electrodes 119*a*-119*d*. For example, the plasma actuators 113*a*-113*d* may be activated by applying a constant voltage across the respective first electrodes 116*a*-116*d* and second electrodes 119*a*-119*d*. As another example, a sinusoidal voltage may be applied to the plasma actuators 113*a*-113*d*. Additionally, each one of the plasma actuators 113*a*-113*d* may be individually activated and deactivated according to a predefined pattern.

Figure 4:
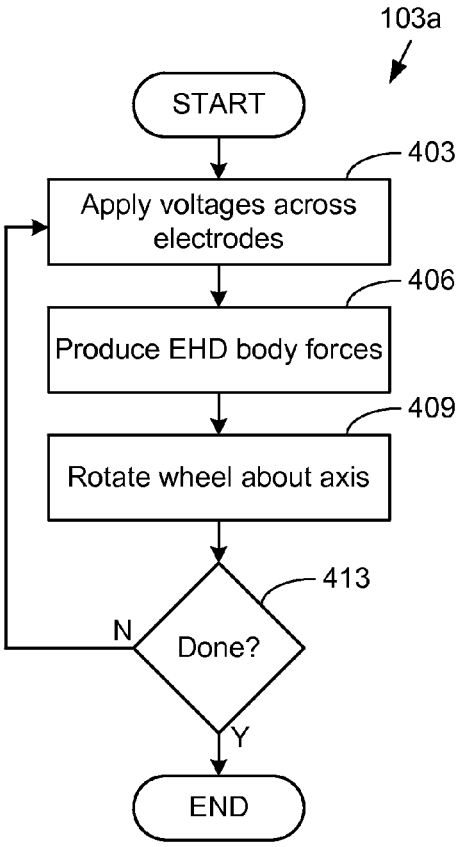
FIG. 4 is a flowchart illustrating an example of functionality implemented by the plasma-driven rotating machine of FIGS. 1A-1B according to various embodiments of the present disclosure.

With reference to FIG. 4, shown is a flowchart that illustrates an example of the operation of the rotating machine 103*a*, which is illustrated in FIGS. 1A-1B. The flowchart of FIG. 4 provides merely an example of the many different types of functional arrangements that may be employed to implement the operation of the rotating machine 103*a* as described herein. The flowchart of FIG. 4 may be viewed as depicting an example of elements of a method performed by a rotating machine 103*a*.

Beginning with element 403, voltages are applied across the respective first electrodes 116*a*-116*d* and second electrodes 119*a*-119*b*. For example, constant voltages may be applied across the respective first electrodes 116*a*-116*d*. Alternatively, varying voltages, such as sinusoidal or square wave voltages, may be applied across the respective first electrodes 116*a*-116*d*. Next, at element 406, EHD body forces are produced as a result of the voltages being applied across the respective first electrodes 116*a*-116*d* and second electrodes 119*a*-119*d*. In turn, the wheel 106 rotates about the axis 111, as shown at element 409, due to the EHD body forces. In one embodiment, the location of the shaft 109 may be fixed, and the EHD body forces may cause the wheel 106 to rotate about the fixed axis 111. In another embodiment, the shaft 109 may be free to travel, and the EHD body forces may cause the wheel 106 to rotate and thereby travel along a surface by rotating about the axis 111.

The rotating machine 103*a* then determines whether the process is done, as indicated at element 413. For example, a controller for the rotating machine 103*a* may include logic circuitry that determines whether the process is complete. Alternatively, the process may be deemed complete if power is removed from the rotating machine 103*a*. If the process is not done, the rotating machine 103*a* then returns to element 403, and the process is repeated as shown. Otherwise, if the process is done, the process ends after element 413.

Figure 5:
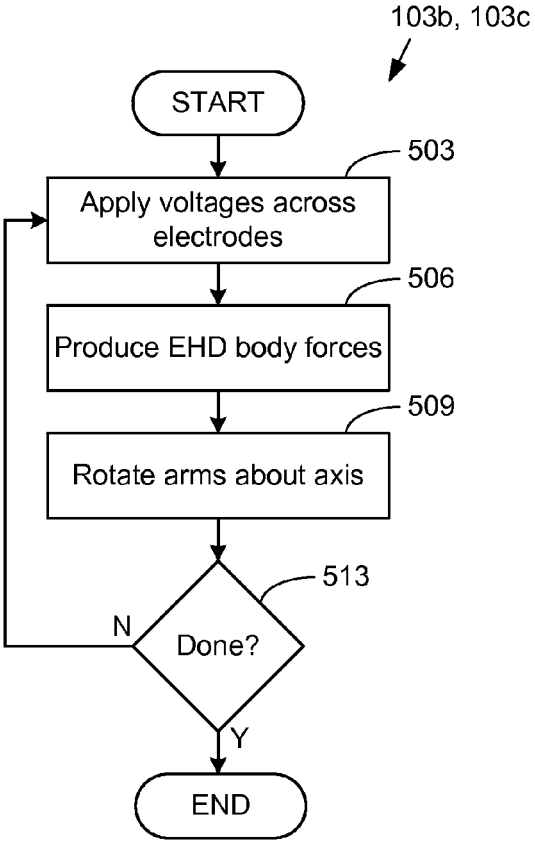
FIG. 5 is a flowchart illustrating an example of functionality implemented by the plasma-driven rotating machine of FIG. 2A-2B or 3A-3B according to various embodiments of the present disclosure.

With reference to FIG. 5, shown is a flowchart that illustrates an example of the operation of the rotating machine 103*b*, which is illustrated in FIGS. 2A-2B, or the rotating machine 103*c*, which is illustrated in FIGS. 3A-3B. The flowchart of FIG. 5 provides merely an example of the many different types of functional arrangements that may be employed to implement the operation of the rotating machine 103*b* or 103*c* as described herein. The flowchart of FIG. 5 may be viewed as depicting an example of elements of a method performed by the rotating machine 103*b* or 103*c*.

Beginning with element 503, voltages are applied across the respective first electrodes 116*a*-116*d* and second electrodes 119*a*-119*b*. For example, constant voltages may be applied across the respective first electrodes 116*a*-116*d*. Alternatively, varying voltages, such as sinusoidal or square wave voltages, may be applied across the respective first electrodes 116*a*-116*d*.

Next, at element 506, EHD body forces are produced as a result of the voltages being applied across the respective first electrodes 116*a*-116*d* and second electrodes 119*a*-119*d*. As a result, the arms 203*a*-203*b*, or 203*a*-203*d*, rotate about the axis 111, as shown at element 509, due to the EHD body forces.

The rotating machine 103*b* or 103*c* then determines whether the process is done, as indicated at element 513. For example, a controller for the rotating machine 103*b* or 103*c* may include logic circuitry that determines whether the process is complete. Alternatively, the process may be deemed complete if power is removed from the rotating machine 103*b* or 103*c*. If the process is not done, the rotating machine 103*b* or 103*c* then returns to element 503, and the process is repeated as shown. Otherwise, if the process is done, the process ends after element 509.

The flowcharts of FIGS. 4 and 5 illustrate an example of the functionality and operation of the rotating machines 103*a*-103*c*, respectively. Although the flowcharts of FIGS. 4 and 5 show a specific order of execution, it is understood that the order of execution may differ from that which is depicted.

Spiral Plasma Actuators

Figure 6B:
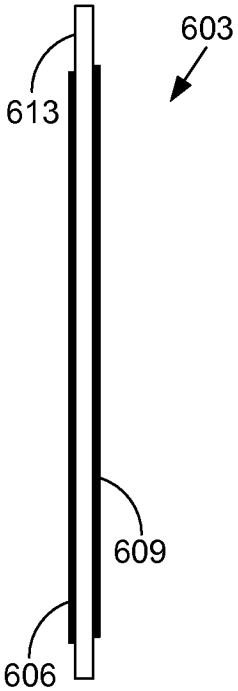
FIGS. 6A-6B are drawings of an example of a plasma actuator with spiral electrodes according to various embodiments of the present disclosure.
Figure 6A:
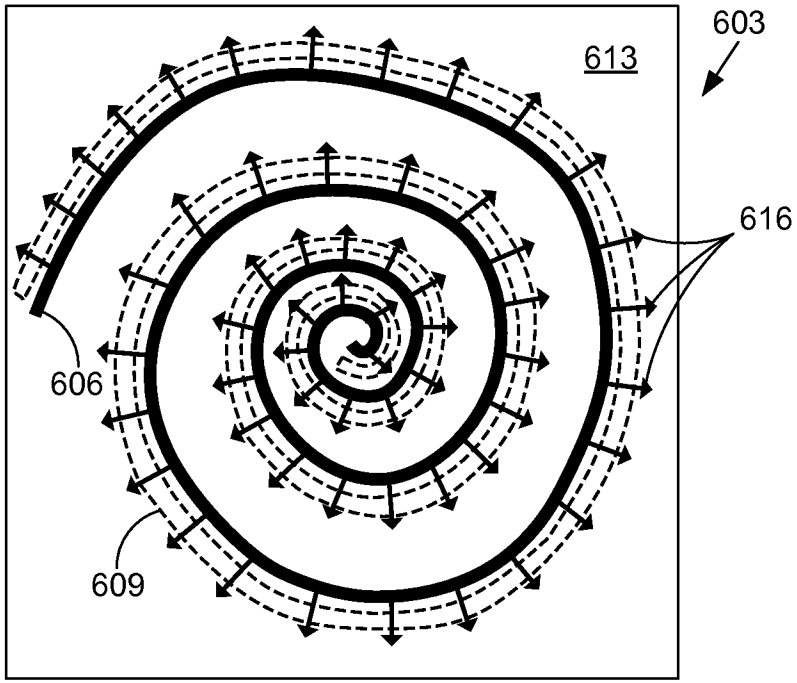

With reference to FIGS. 6A-6B, shown is a spiral plasma actuator 603 according to various embodiments of the present disclosure. The spiral plasma actuator 603 may include one or more first spiral electrodes 606, one or more corresponding second spiral electrodes 609, a dielectric separator 613, and/or other components. The first spiral electrode 606 and/or the second spiral electrode 609 may have Archimedean spiral geometries, Fibonacci spiral geometries, logarithmic spiral geometries, or any other suitable spiral geometries according to various embodiments. In addition, the first spiral electrode 606 and/or the second spiral electrode 609 in some embodiments may be segmented, such that the first spiral electrode 606 and/or the second spiral electrode 609 includes multiple discontinuous portions.

The dielectric separator 613 may comprise a planar dielectric material. In some embodiments, the dielectric separator 613 may be omitted, and the first spiral electrode 606 may be separated from the second spiral electrode 609 by any suitable support mechanism. In embodiments where the dielectric separator 613 is omitted, a fluid, such as air or any other fluid, may be present between the first spiral electrode 606 and the second spiral electrode 609.

The spiral plasma actuator 603 may be activated using a signal generator. I various embodiments, the signal generator is capable of applying voltages with various types of waveforms across the first spiral electrode 606 and the second spiral electrode 609. For example, a constant voltage may be applied across the respective first spiral electrode 606 and the second spiral electrode 609. As another example, a sinusoidal voltage may be applied across the first spiral electrode 606 and the second spiral electrode 609.

As a result of a voltage being applied across the first spiral electrode 606 and the second spiral electrode 609, an EHD body force may be induced in the directions indicated by the arrows 616. For embodiments in which the voltage waveform is sinusoidal or pulsed, for example, the EHD body force may also be sinusoidal or pulsed. Such resulting EHD body forces may generate waves in the fluid in which the spiral plasma actuator is located. The waves in the fluid may be perceived as vibrations or sound. As such, the spiral plasma actuator 603 may generate sound waves. Additionally, the signal generator may energize the first spiral electrode 606 and the second spiral electrode 609 such that the resulting fluidic flow includes a pinching flow along with one or more waves.

Additionally, some embodiments of the spiral plasma actuator 603 may be used to perform active noise reduction. To this end, the spiral plasma actuator 603 may be coupled to a controller (not shown) that analyzes the sound in the environment in which the spiral plasma actuator 603 is located. The controller may output a voltage waveform across the first spiral electrode 606 and the second spiral electrode 609 so that the sound generated by the spiral plasma actuator 603 destructively interferes with at least one other sound in the environment.

Figure 7:
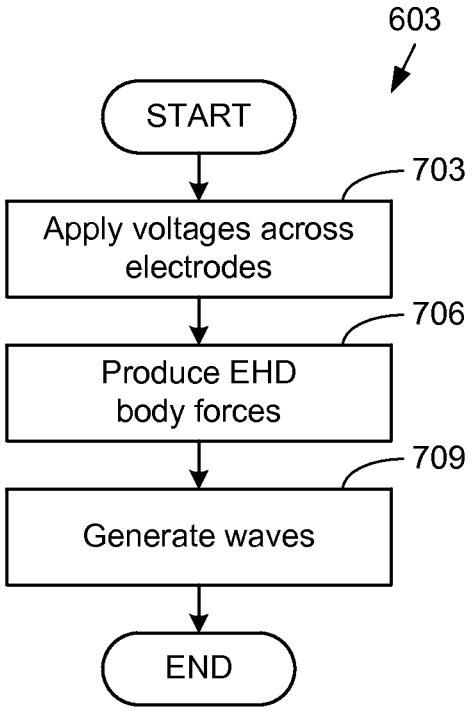
FIG. 7 is a flowchart illustrating an example of functionality implemented by the plasma actuator of FIGS. 6A-6B according to various embodiments of the present disclosure.

With reference to FIG. 7, shown is a flowchart that illustrates an example of the operation of spiral plasma actuator 603, which is illustrated in FIGS. 6A-6B. The flowchart of FIG. 7 provides merely an example of the many different types of functional arrangements that may be employed to implement the operation of the spiral plasma actuator 603 as described herein. The flowchart of FIG. 6 may be viewed as depicting an example of elements of a method performed by the spiral plasma actuator 603.

Beginning at element 703, voltages are applied across the first spiral electrode 606 and the second spiral electrode 609. For example, a sinusoidal voltage or any other suitable dynamic voltage may be applied across the first spiral electrode 606 and the second spiral electrode 609. As a result of the voltages being applied across the first spiral electrode 606 and the second spiral electrode 609, EHD body forces are produced, as indicated at element 706. In turn, waves are generated in the fluid in which the spiral plasma actuator 603 is located. These waves may be perceived as vibrations or sound waves. Additionally, the waves may be generated in order to perform active noise cancellation.

The spiral plasma actuator 603 then determines whether the process is done, as indicated at element 713. For example, a controller for the spiral plasma actuator 603 may include logic circuitry that determines whether the process is complete. If the process is not done, the spiral plasma actuator 603 then returns to element 703, and the process is repeated as shown. Otherwise, is the process it done, the process ends after element 713.

The flowchart of FIG. 7 illustrates an example of the functionality and operation of the spiral plasma actuator 603. Although the flowchart of FIG. 7 shows a specific order of execution, it is understood that the order of execution may differ from that which is depicted.

Fluid Circulator

Figure 8B:
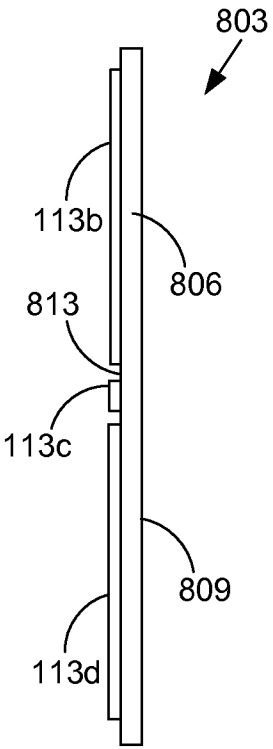
FIGS. 8A-8B are drawings of an example of a fluid circulator according to various embodiments of the present disclosure.
Figure 8A:
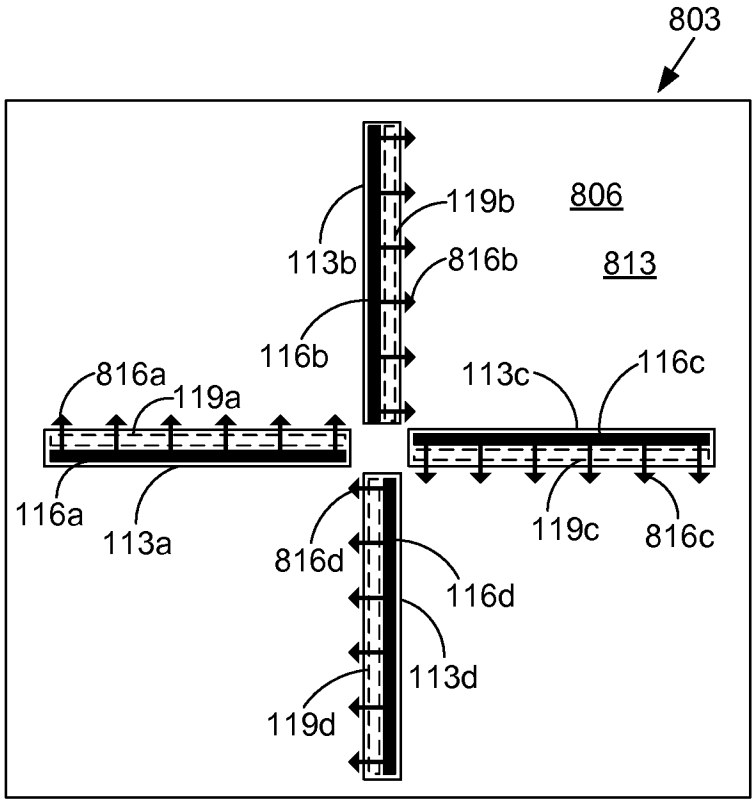

With reference to FIGS. 8A-8B, shown is an example of a fluid circulator 803 according to various embodiments of the present disclosure. The fluid circulator 803 may include one or more plasma actuators 113*a*-113*d*, a dielectric film 806, and/or other components.

The dielectric film 806 may comprise a relatively thin, flexible sheet of material, such as plastic, paper, rubber, any other suitable material, and/or any combination thereof. A first side 809 of the dielectric film 806 may include an adhesive and/or any other type of mechanism that may facilitate mounting the dielectric film onto a surface. Such a surface may include, but is not limited to, a wall, ceiling, floor, window, and/or any other suitable surface.

One or more plasma actuators 113*a*-113*d* may be disposed on a second side 813 of the dielectric film 806. The geometries of the plasma actuators 113*a*-113*d* may be linear, curved, serpentine, spiral, segmented, any other suitable geometry, or any combination of multiple suitable geometries.

The fluid circulator 803 may be mounted on a wall, ceiling, floor, window, and/or any other type of surface. To this end, an adhesive and/or any other suitable type of mechanism on the first side 809 of the dielectric film 806 may hold the fluid circulator 803 in position against such a surface.

The plasma actuators 113*a*-113*d* may be activated using a signal generator. In various embodiments, the signal generator is capable of applying voltages with various types of waveforms across the respective first electrodes 116*a*-116*d* and second electrodes 119*a*-119*d*. For example, the plasma actuators 113*a*-113*d* may be activated by applying a constant voltage across the respective first electrodes 116*a*-116*d* and second electrodes 119*a*-119*d*. As another example, a sinusoidal voltage may be applied to the plasma actuators 113*a*-113*d*. Additionally, each one of the plasma actuators 113*a*-113*d* may be individually activated and deactivated according to a predefined pattern.

When the plasma actuators 113*a*-113*d* are activated, respective EHD body forces may be produced in the directions shown by the arrows 816*a*-816*d*. For purposes of clarity, only some of the arrows 816*a*-816*d* are labeled in FIG. 5A. The EHD forces produced by the plasma actuators 113*a*-113*d* may influence the flow of the fluid, such as air or any other fluid, in which the fluid circulator 803 is located. Thus, the fluid circulator 803 may, for example, produce wind in a room. Because the fluid circulator 803 may produce wind without the use of moving parts, the fluid circulator 803 may be regarded as being a solid-state fan. Because the fluid circulator 803 may influence the flow of a fluid in an environment, the fluid circulator 803 may be used to facilitate heat transfer in the environment. For example, the fluid circulator 803 may be used to cool various types of objects, such as electrical components, people, and/or any other object located in the environment in which the fluid circulator 803 operates.

Figure 9:
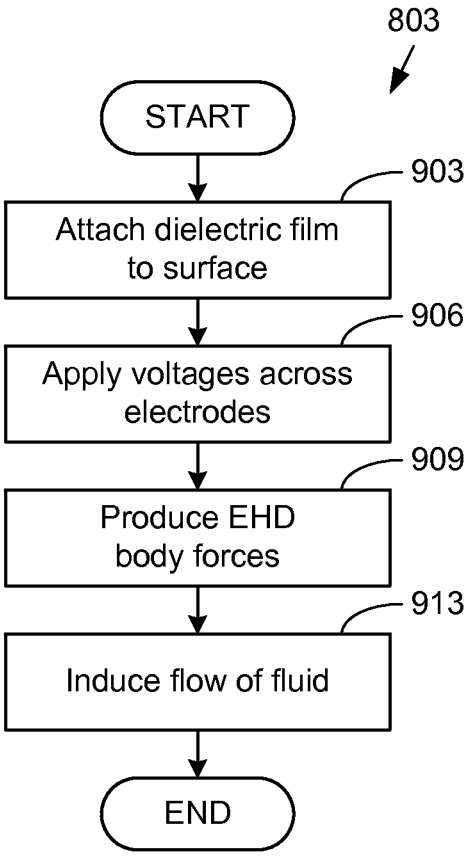
FIG. 9 is a drawing of an example of functionality implemented by the fluid circulator of FIGS. 8A-8B according to various embodiments of the present disclosure.

With reference to FIG. 9, shown is a flowchart that illustrates an example of the operation of the fluid circulator 803, which is illustrated in FIGS. 8A-8B. The flowchart of FIG. 9 provides merely an example of the many different types of functional arrangements that may be employed to implement the operation of the fluid circulator 803 as described herein. The flowchart of FIG. 9 may be viewed as depicting an example of elements of a method performed by the fluid circulator 803.

Beginning at element 903, the dielectric film 806 is attached to a surface, such as a wall, ceiling, window, or any other suitable surface. In some embodiments, the dielectric film 806 is attached to the surface using an adhesive that is located on the fluid circulator 803.

Next, at element 906, voltages are applied across the first electrodes 116*a*-116*d* and the second electrodes 119*a*-119*d*. For example, a constant voltage may be applied across the first electrodes 116*a*-116*d* and the second electrodes 119*a*-119*d*. In another example, varying voltages, such as a sinusoidal or square wave voltages, are applied across the first electrodes 116*a*-116*d* and the second electrodes 119*a*-119*d*. As a result of the voltages being applied across the first electrodes 116*a*-116*d* and the second electrodes 119*a*-119*d*, EHD body forces are produced, as indicated at element 909. In turn, the EHD body forces induce the flow of the fluid in which the fluid circulator 803 is located. Thus, the fluid circulator 803 may generate wind in a room, for example.

The fluid circulator 803 then determines whether the process is done, as indicated at element 916. For example, a controller for the fluid circulator 803 may include logic circuitry that determines whether the process is complete. Alternatively, the process may be deemed complete if power is removed from the fluid circulator 803. If the process is not done, the fluid circulator 803 then returns to element 906, and the process is repeated as shown. Otherwise, if the process is done, the process ends after element 916.

The flowchart of FIG. 9 illustrates an example of the functionality and operation of the fluid circulator 803. Although the flowchart of FIG. 9 shows a specific order of execution, it is understood that the order of execution may differ from that which is depicted.

As used herein, disjunctive language, such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language does not imply that certain embodiments require at least one of X, at least one of Y, or at least one of Z to each be present.

It is understood that the above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included within the scope of the present disclosure.

Therefore, the following is claimed:

1. An apparatus, comprising:

a plasma actuator that comprises at least one first electrode and at least one second electrode; and at least one dielectric film that physically separates the at least one first electrode and the at least one second electrode of the plasma actuator, wherein the at least one dielectric film comprises an adhesive on one side to attach the one side of the at least one dielectric film to a surface to facilitate the plasma actuator providing fluidic flow for an environment.

2. The apparatus of claim 1, wherein the at least one dielectric film comprises a planar dielectric material.

3. The apparatus of claim 1, wherein the at least one dielectric film comprises a flexible sheet.

4. The apparatus of claim 1, wherein the plasma actuator comprises at least one serpentine electrode.

5. The apparatus of claim 1, wherein the plasma actuator is among a plurality of plasma actuators on the dielectric film.

6. The apparatus of claim 1, wherein the plasma actuator cools an object by facilitating a heat transfer in the environment.

7. The apparatus of claim 1, wherein the plasma actuator generates wind for a room.

8. An apparatus, comprising:

a support member;

a rotating member; and a plasma actuator attached to the rotating member such that the plasma actuator causes the rotating member to rotate about an axis defined by the support member.

9. The apparatus of claim 8, wherein the plasma actuator is among a plurality of plasma actuators that are attached to the rotating member.

10. The apparatus of claim 9, wherein individual ones of the plurality of plasma actuators are configured to be individually activated according to a predefined pattern.

11. The apparatus of claim 8, wherein:

the rotating member comprises an arm; and the plasma actuator is attached to the arm.

12. The apparatus of claim 8, wherein:

the rotating member comprises a wheel; and the plasma actuator is attached to the wheel.

13. The apparatus of claim 8, wherein:

the rotating member comprises a wheel; and the support member comprises an axle.

14. The apparatus of claim 8, wherein the plasma actuator comprises at least one of a linear electrode, a serpentine electrode, or a spiral electrode.

15. The apparatus of claim 8, wherein the plasma actuator cools an object by facilitating a heat transfer.

16. The apparatus of claim 8, further comprising an object that is propelled by the plasma actuator.

17. An apparatus, comprising:

a spiral plasma actuator comprising a first spiral electrode and a second spiral electrode; and a signal generator electrically coupled to the first spiral electrode and the second spiral electrode, wherein the signal generator is configured to apply a voltage across the first spiral electrode and the second spiral electrode to cause the spiral plasma actuator to generate waves in a fluid.

18. The apparatus of claim 17, wherein:

the fluid comprises air; and the signal generator is configured to cause the spiral plasma actuator to generate a plurality of sound waves in the air.

19. The apparatus of claim 17, wherein the signal generator is configured to cause the spiral plasma actuator to reduce a sound generated by a source other than the spiral plasma actuator.

20. The apparatus of claim 17, wherein the spiral plasma actuator cools an object by facilitating a heat transfer.

* * * * *